US010232375B2

(12) United States Patent
Eberle et al.

(10) Patent No.: US 10,232,375 B2
(45) Date of Patent: Mar. 19, 2019

(54) SUPPORT DEVICE FOR A SAMPLE MATERIAL CONTAINER FOR CENTRIFUGATION

(71) Applicant: ANDREAS HETTICH GMBH & CO. KG, Tuttlingen (DE)

(72) Inventors: Klaus Gunter Eberle, Tuttlingen (DE); Timo Liebermann, Muhlheim (DE); Christoph Pabst, Tuttlingen (DE)

(73) Assignee: ANDREAS HETTICH GMBH & CO. KG, Tuttlingen (DE)

( * ) Notice: Subject to any disclaimer, the term of this patent is extended or adjusted under 35 U.S.C. 154(b) by 174 days.

(21) Appl. No.: 14/773,276

(22) PCT Filed: Mar. 27, 2014

(86) PCT No.: PCT/EP2014/056208
§ 371 (c)(1),
(2) Date: Sep. 4, 2015

(87) PCT Pub. No.: WO2014/154827
PCT Pub. Date: Oct. 2, 2014

(65) Prior Publication Data

US 2016/0016173 A1 Jan. 21, 2016

(30) Foreign Application Priority Data

Mar. 27, 2013 (DE) ..... 10 2013 103 153

(51) Int. Cl.
*B01L 9/00* (2006.01)
*B04B 5/04* (2006.01)

(52) U.S. Cl.
CPC ..... *B01L 9/00* (2013.01); *B04B 5/0428* (2013.01); *B01L 2200/021* (2013.01);
(Continued)

(58) Field of Classification Search
None
See application file for complete search history.

(56) References Cited

U.S. PATENT DOCUMENTS 3,786,986 A * 1/1974 Guerrero ..... B04B 5/0421 267/158
3,830,425 A 8/1974 Stallmann
(Continued)

FOREIGN PATENT DOCUMENTS

CN 2257742 7/1997
CN 1321095 11/2001
(Continued)

OTHER PUBLICATIONS

The State Intellectual Property Office of P.R. China, Office Action, dated Oct. 9, 2016, pp. 1-8, Application No. 201480017108.X, Applicant: Andreas Hettich GMBH & Co. KG.
(Continued)

*Primary Examiner* — Shogo Sasaki
(74) *Attorney, Agent, or Firm* — Woodling, Krost and Rust

(57) ABSTRACT

The invention relates to a support device (14) for supporting a bag (20) containing material to be centrifuged in a centrifuge receptacle (12), said support device (14) comprising a resiliently elastic panel (16) which—when bent—will generate a restoring force, said panel (16) being of a material and a size which will allow it to be bent elastically at least to such an extent that its two ends will contact one another.

13 Claims, 6 Drawing Sheets

(52) U.S. Cl.
CPC . *B01L 2300/0809* (2013.01); *B01L 2300/123* (2013.01); *B04B 2005/0435* (2013.01)

(56) References Cited

U.S. PATENT DOCUMENTS

| | | | | |
|---|---|---|---|---|
| 4,447,220 | A | 5/1984 | Eberle | |
| 4,892,668 | A | 1/1990 | Harmony et al. | |
| 6,159,321 | A | 12/2000 | Whisson | |
| 2014/0087360 | A1* | 3/2014 | Woodside ..... | G01N 33/491 435/2 |

FOREIGN PATENT DOCUMENTS

| | | |
|---|---|---|
| CN | 1426843 | 7/2003 |
| CN | 2644003 | 9/2004 |
| DE | 7219685 | 2/1975 |
| DE | 202005015644 | 3/2007 |
| WO | 2011065716 | 6/2011 |

OTHER PUBLICATIONS

The State Intellectual Property Office of P.R. China, English Translation of the Office Action and Search Report, dated Oct. 9, 2016, pp. 1-11, Application No. 201480017108.X, Applicant: Andreas Hettich GMBH & Co. KG.

The International Bureau of WIPO, International Preliminary Report on Patentability, dated Sep. 29, 2015, International Application No. PCT/EP2014/056208, Applicant: Andreas Hettich GMBH.

European Patent Office, International Search Report, dated Jun. 20, 2014, pp. 1-10, International Application No. PCT/EP2014/056208, Applicant: Andreas Hettich GMBH & Co. KG.

* cited by examiner

SUPPORT DEVICE FOR A SAMPLE MATERIAL CONTAINER FOR CENTRIFUGATION

This application claims the benefit and priority of and to PCT/EP2014/056208, international application filing date Mar. 27, 2014, which claims the benefit and priority of and to: German patent application no. 10 2013 103 153.6, filed Mar. 27, 2013. PCT/EP2014/056208, international application filing date Mar. 27, 2014, and German patent application no. 10 2013 103 153.6, filed Mar. 27, 2013 are incorporated herein by reference hereto.

The invention relates to a support device for a sample material container for centrifugation.

Centrifuge receptacles are often loaded with sample material containers, in particular in the form of bags, for centrifugation. During centrifugation, the changed mass distribution often affects the shape of a sample container, in particular a bag, held in the centrifuge receptacle. This leads to the formation of pockets, folds or the like already at the beginning of the centrifugation process, due to the change in position and shape of the bag. As a result, it will be impossible to completely separate the sample material during centrifugation.

Removing a deformed bag will also prove difficult, since the separate layers obtained by centrifugation may break up again when the deformed bag is taken out. These problems are a major issue in the centrifugation and analysis of blood.

Document DE 20 2005 015 644 U1 describes a centrifuge beaker whose lid is provided with a support for clamping a blood bag to the upper edge of the beaker. For this purpose, connection pieces provided on the blood bag are received in the support. This support allows individual blood bags to be securely retained.

Document U.S. Pat. No. 6,159,321 US discloses a support device for a sample material container for centrifugation, which device consists of a flexible ribbon whose height corresponds to that of a sample material container for centrifugation and which can be wrapped around the sample material container. An adhesive mechanism is also provided to allow either end of the ribbon to be fixed in position relative to one another, which thus affords support for the wrapped sample material container for centrifugation. Although this constitutes an adaptable support device, its shortcoming is that it is not capable of retaining the shape of a flexible container, for example a blood bag, which thus has a negative impact on the separation result.

It is therefore the object of the present invention to provide a device which allows a sample material container for centrifugation to be variably supported within a centrifuge receptacle and which can be adapted to different sample material containers, at the same time avoiding the above mentioned shortcomings.

This object is accomplished according to the invention by providing a support device which is placed in a centrifuge receptacle next to a sample container, in particular a bag, holding the material to be centrifuged. According to the invention, the support device comprises a resilient panel whose material and dimensions have been chosen so as to cause the panel to generate a restoring force upon its deformation which will ultimately urge the panel to resume its original shape. In addition, the material and the dimensions chosen for the panel have been selected such that the panel can be bent about a bending axis at least to such an extent that the tangential planes defined along its edges which are in parallel to the bending axis will define a bending angle of between 0° and 90° between them.

The resilient behaviour of the resiliently flexible panel thus allows the original shape of the sample material container for centrifugation to be retained even if the latter is clamped in place by the restoring force generated by the support device.

Preferably, its bending elasticity can be chosen such that two opposing edges extending in parallel to the bending axis on the ends of the panel can be made to contact one another. Its bending elasticity may also be chosen such that after bending the panel about a bending axis, said opposing surfaces may at least partially contact one another.

Its bending elasticity allows the panel to be placed in a centrifuge receptacle next to a sample material container for centrifugation in such a way that when the panel is bent about its bending axis, the panel will be divided into a support portion which contacts the bag, and a bracing portion which braces the panel against the centrifuge receptacle wall.

As a result, the bracing portion, which is located above an envisaged bending axis when the panel has been inserted vertically but not yet been bent, can be bent over downward so as to cause the bracing portion to press against the receptacle wall with the applied restoring force. The panel's support portion which rests against the sample material container will thus form a wall which presses the sample material container against the centrifuge receptacle wall or another support device. The pressure is generated in particular in the area of the bending axis. The bending axis may preferably be chosen so as to be located at the upper end of the inserted bag. This will ensure that the sample material container will be firmly held in an upright position within the centrifuge receptacle, even during the centrifugation process. This will also effectively prevent the formation of folds.

The device according to the invention allows the position of the bending axis and thus the division of the panel into bracing and support portions to be freely chosen. The fact that the bending axis can be freely chosen makes the support device easily adaptable to different containers and/or bag sizes. The decision as to where the bending axis should be, first of all depends on the size of the sample material container and secondly on its filling level. The selected position of the bending axis is of particular relevance if there are drain connections for discharging the centrifuged content. The support device according to the invention thus constitutes a variable insert for use with numerous different types of sample material containers for centrifugation.

According to another embodiment of the invention, a handling element is provided one end of the panel. The handling element is designed so as to facilitate access to the bracing portion bent over downward toward the bottom of the centrifuge receptacle. Operation of the handling element allows the bracing of the resiliently flexible panel to be released in a controlled manner, thus preventing the separated layers of the centrifuged material from breaking up.

Preferably, the handling element is designed as a tab. The design and material for this tab have been chosen such that the tab will be resiliently flexible. Its resilience allows the tab to abut on the centrifuge receptacle wall. The bracing force generated during centrifugation will act to hold the tab firmly in place between the support device and the receptacle wall so as to prevent it from sliding down to the bottom of the receptacle. Consequently, the tab can still be reached easily even after completion of the centrifugation process.

Plastic is considered an advantageous choice of material for the support device of the invention as this material will readily provide the required bending elasticity for the panel.

In an embodiment which is considered particularly advantageous, the panel is made of silicone. Silicone can be cleaned very easily which is a crucial aspect in view of the likelihood of the support device becoming contaminated during centrifugation. Specifically, the panel may have a smooth essentially non-porous surface so as to facilitate cleaning.

Preferably, the length of the panel should exceed the height of the centrifugation sample material container. A projecting length of more than one third of the length of the bag has been found to be particularly advantageous.

For conventional centrifugation sample material containers, in particular blood bags, this corresponds to a panel length of approx. 20 cm.

The panel thickness should preferably be chosen as thin as possible, but still thick enough to ensure a sufficient restoring force for supporting the bag before and after centrifugation. This prerequisite is especially well met by a thickness ranging between 0.5 cm and 2 cm. The panel thickness may thus be between 0.2 cm and 0.5 cm, i.e. of the order of 0.2 cm to 2 cm.

According to yet another aspect of the invention, a centrifuge receptacle assembly has been provided which comprises a centrifuge receptacle and a support device of the aforementioned design. In such a centrifuge receptacle assembly, a support device of this type can be firmly or detachably mounted within said centrifuge receptacle. The support device will be placed in the centrifuge receptacle next to the sample material container. The sample material container will be braced relative to the centrifuge receptacle in the aforementioned way.

The centrifuge receptacle assembly may preferably be chosen such that the panel will be no wider than the maximum width and/or diameter of the centrifuge receptacle. This will safely prevent the support device from being bent about its longitudinal axis, and at the same time ensure that the full width of support portion of the panel will abut on the container.

In a further development of the centrifuge receptacle assembly, the panel length has been chosen such that the panel will project over the height of the centrifuge receptacle space by at least one third. This will facilitate the folding in of the bracing portion and ensure that a bending axis can also be obtained at the level of the upper edge of the centrifuge receptacle, with sufficient bracing force being provided.

A further object of the invention is the use of a support device of the aforementioned type for supporting a container placed in a centrifuge receptacle.

According to an advantageous application, the panel is inserted into the centrifuge receptacle in parallel to the sample material container, and then an upper bracing portion is bent away from the bag about a bending axis which essentially extends in parallel to the bottom of the receptacle. The bag will thus be supported by the support portion abutting thereon.

Further advantages, features and possible applications of the present invention may be gathered from the description which follows, in which reference is made to the embodiments illustrated in the drawings.

Throughout the description, claims and drawings, those terms and associated reference signs are used as are listed in the List of Reference Signs below. In the drawings:

Figure 5A:
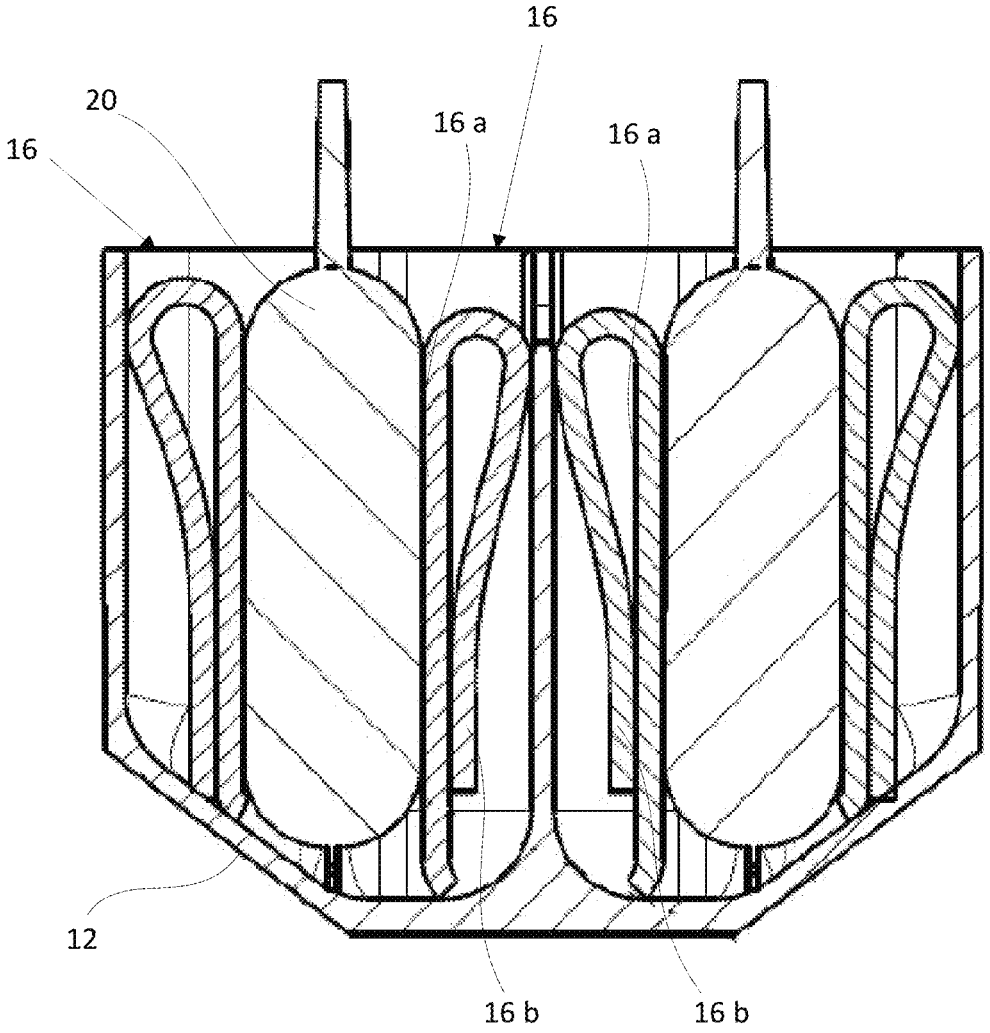
Figure 5B:
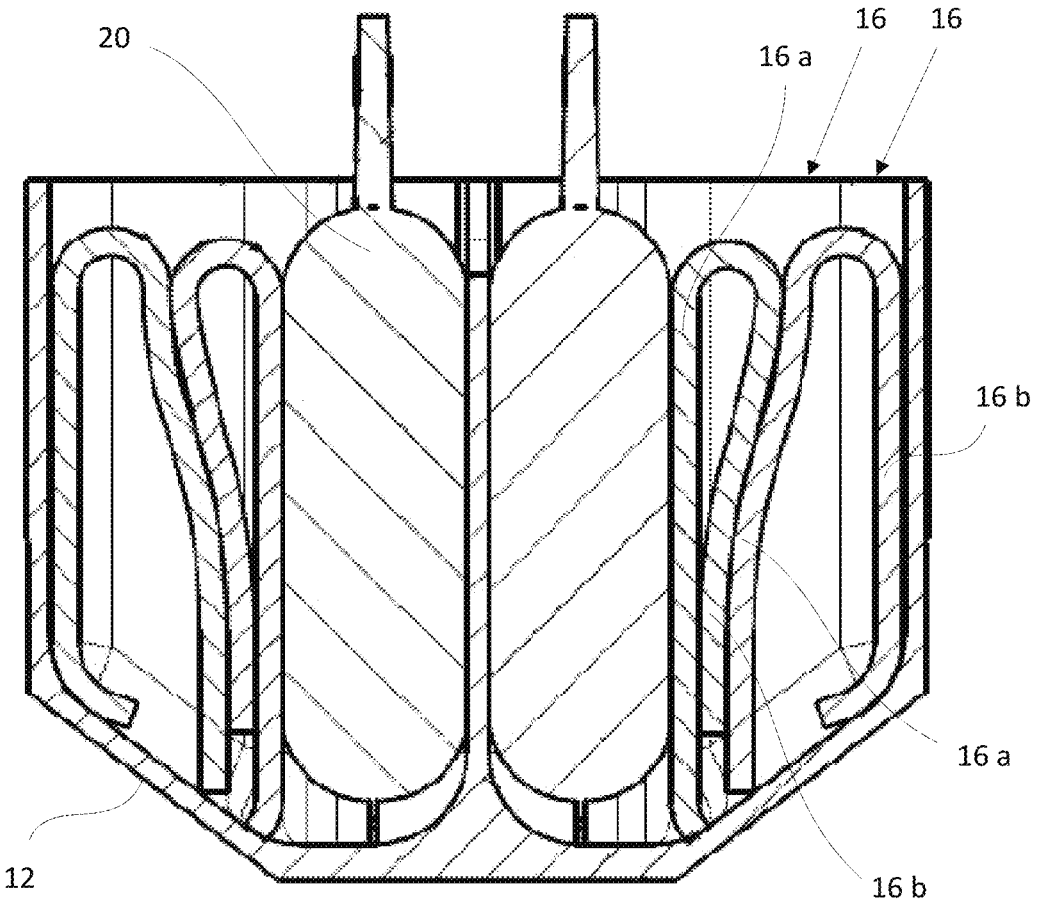

FIG. 5*a* is a schematic sectional view of centrifuge receptacles each being provided with two support devices according to the invention, and FIG. 5*b* a schematic sectional view of centrifuge receptacles each being provided with two support devices according to the invention.

Figure 1:
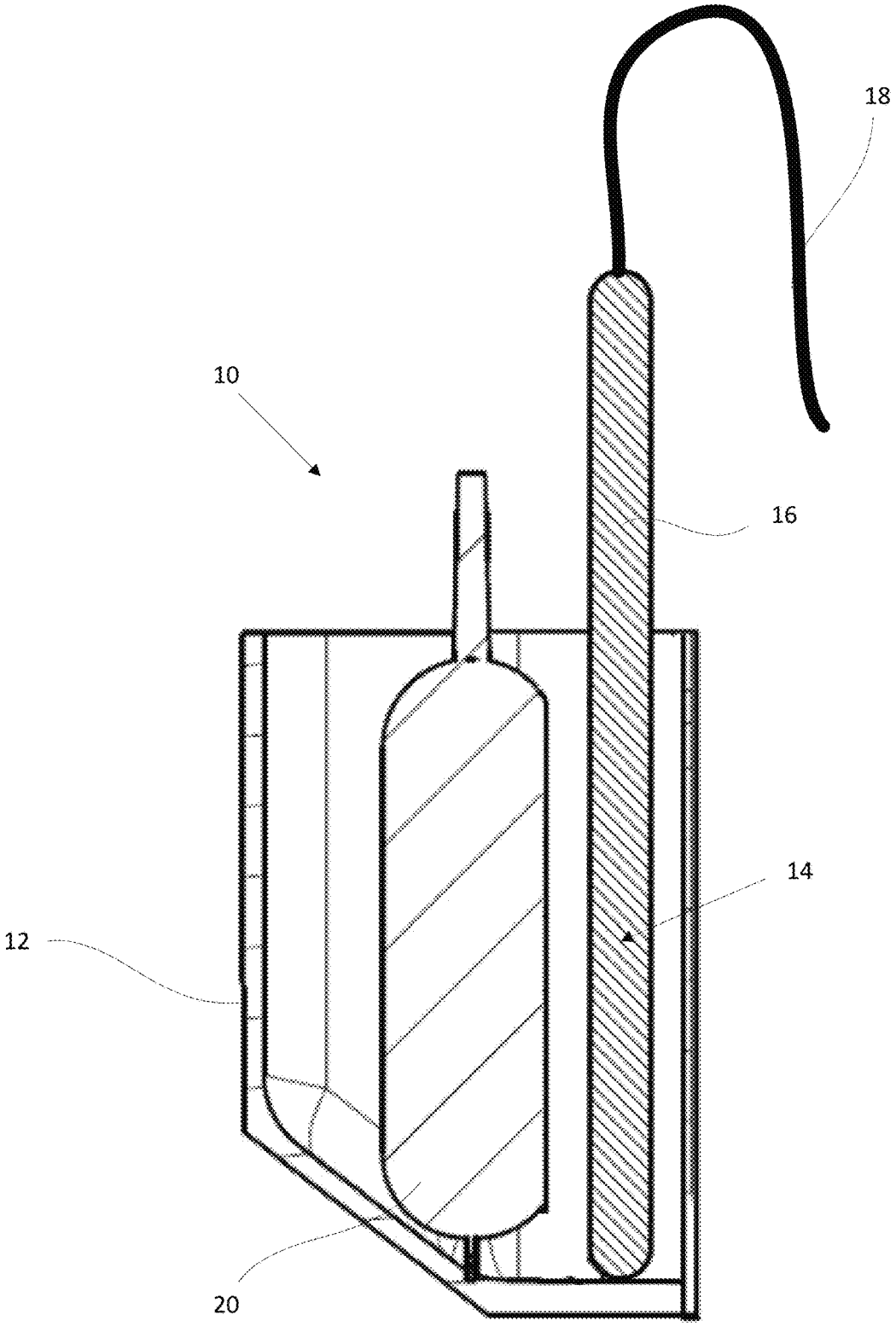
FIG. 1 is a view of a centrifuge receptacle assembly.

FIG. 1 is a view of a centrifuge receptacle assembly 10 comprising a centrifuge receptacle 12 and a support device 14. The support device 14 additionally comprises a resiliently flexible panel 16 as well as a resiliently flexible tab 18 integrally formed on one of its ends.

The view of FIG. 1 is a centrifuge receptacle assembly 10 in which a blood bag 20 placed in a centrifuge receptacle 12 can be supported by a support device 14 which has been vertically inserted into the centrifuge receptacle 12. The support device 14 comprises a resiliently flexible silicone panel 16 whose length has been selected to be twice the height of the centrifuge receptacle 12. Mounted on the upper end of the silicone plate 16 is a tab 18 made of plastic. The blood bag 20 and the support device 14 have been inserted into the centrifuge receptacle in such a way that the blood bag 20 is located between the silicone panel 16 and the inner wall of the centrifuge receptacle 12.

Figure 2:
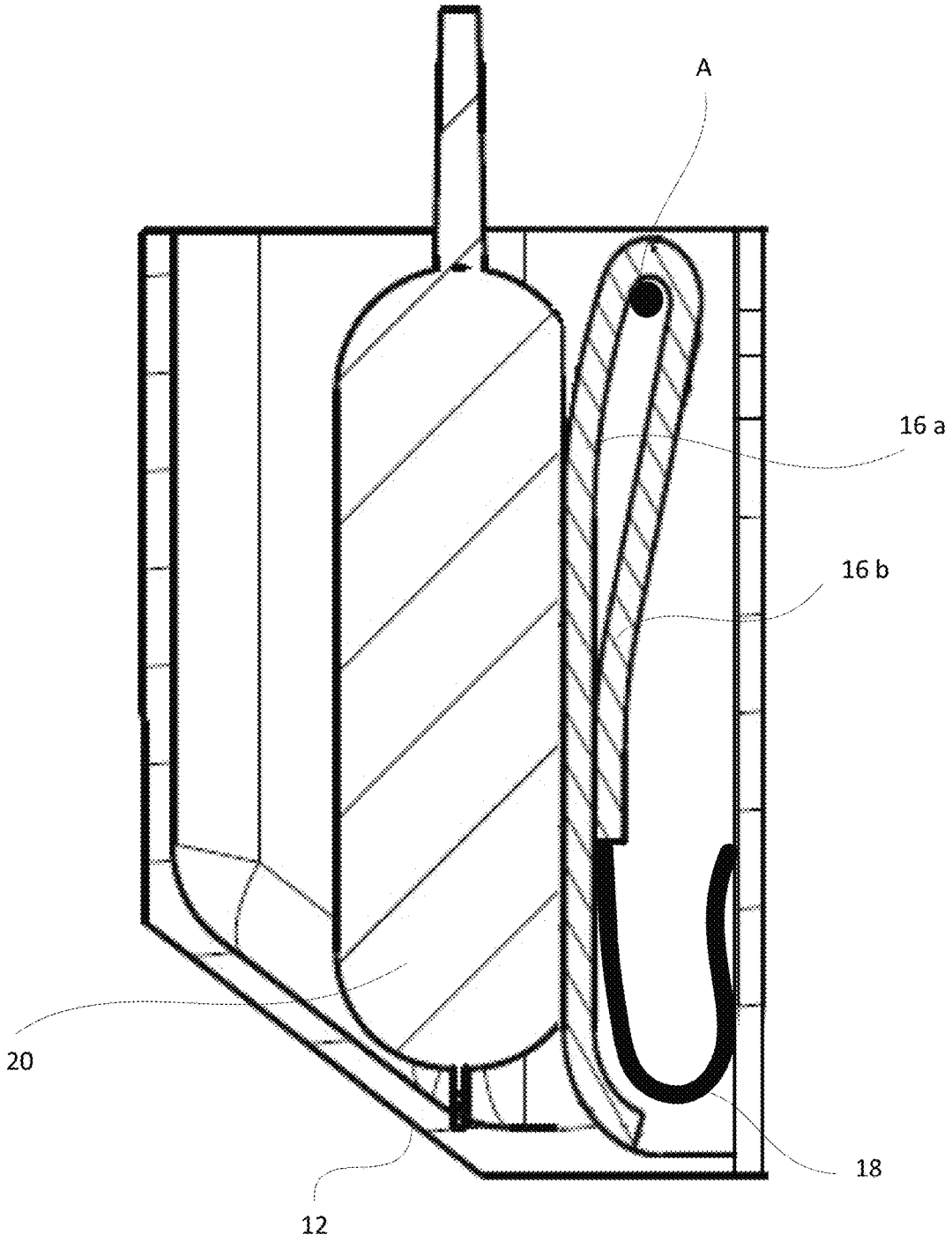
FIG. 2 is a view of a vertically inserted support device.

The view of FIG. 2 illustrates a next step in which the vertically inserted support device 14, which extends in parallel next to the blood bag 20, is bent about a bending axis A. The bending axis A divides the silicone panel 16 into a support portion 16*a* and a bracing portion 16*b*. The bracing portion 16*b* presses against the wall of the centrifuge receptacle 12 which faces away from the blood bag 20, thus bracing in particular the upper portion of the blood bag 20 which is thus pressed against the centrifuge receptacle wall on the side of the blood bag. Owing to the resiliently flexible design of the silicone panel 16, pressure will be exerted on the entire blood bag 20. However, the largest pressing force will be exerted in the area of the bending axis A. This ensures that above all the connections of the blood bag will be firmly held in position in the upper area of the centrifuge receptacle 12.

Moreover, this view shows the resiliently flexible tab 18. The resiliently flexible design of the tab 18 ensures that the latter will not be pressed down toward the bottom of the container during centrifugation, but will still be readily accessible after centrifugation. As can clearly be seen in the view of FIG. 2, the pressing region is approximately at the level of the bending axis A which thus fixes the connections of the blood bag 20 in place above the edge of the container. The pressure created by the restoring force will suffice to support this blood bag 20 even under the influence of the centrifugal forces.

Figure 3:
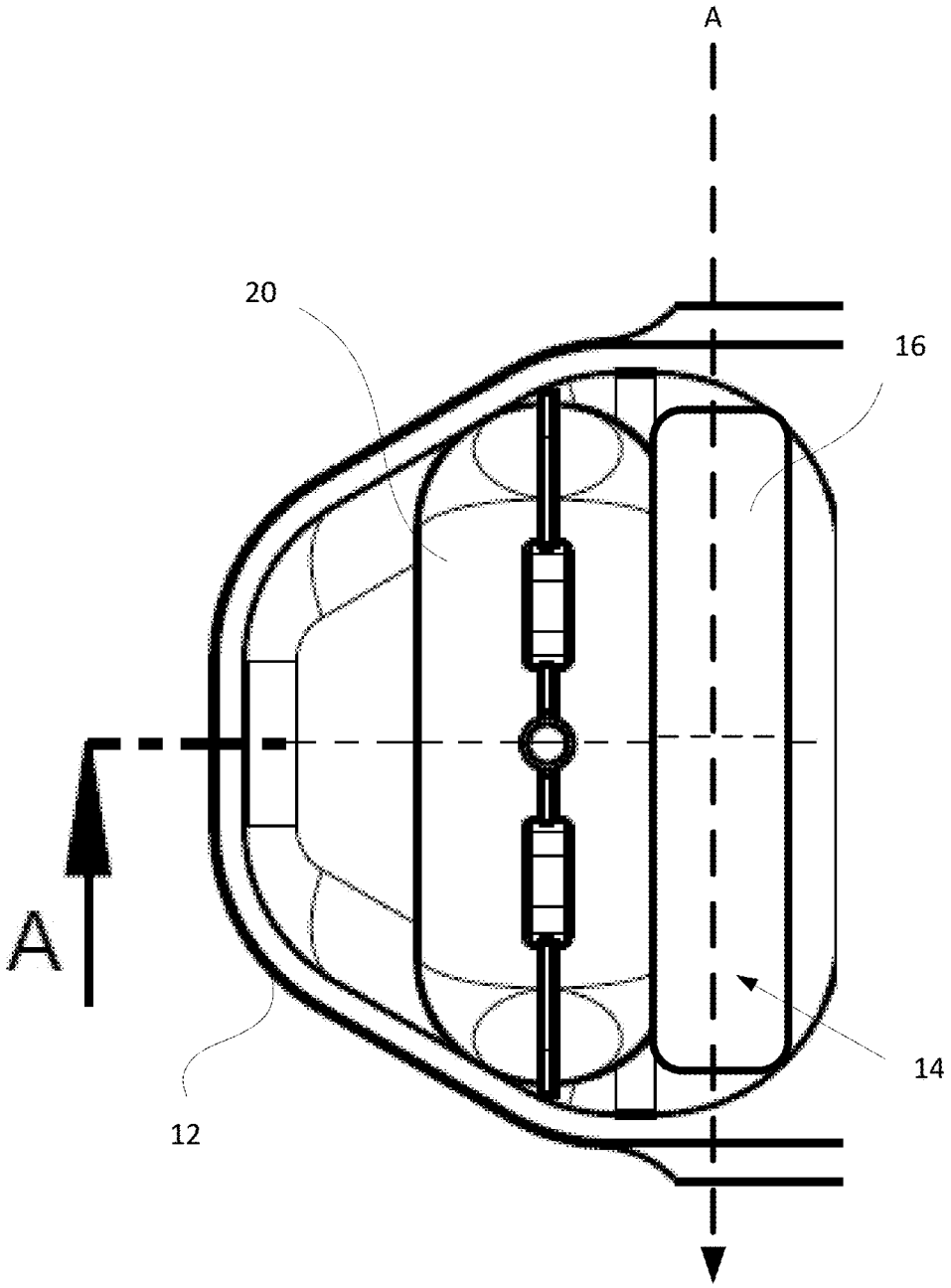
FIG. 3 is a top view of the centrifuge receptacle.

FIG. 3 is a top view of the centrifuge receptacle 12 with the blood bag 20 clamped in place and the support device 14 inserted therein, in which the position of the bending axis A of panel 16 can be seen particularly well.

Figure 4:
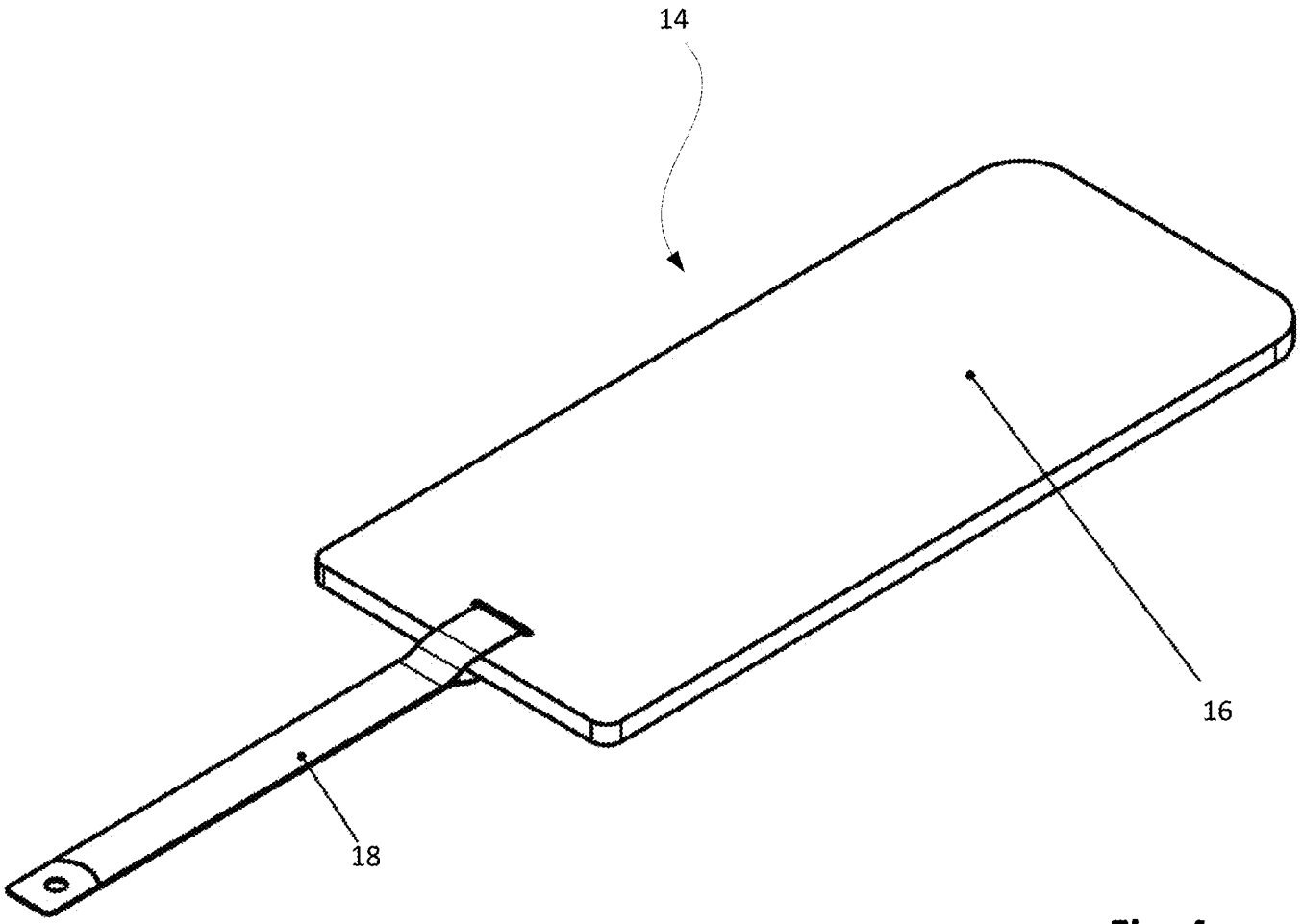
FIG. 4 is a perspective view of a support device according to the invention.

FIG. 4 is a perspective view of a support device 14 according to the invention, comprising a resiliently elastic panel 16 as well as a resiliently elastic tab 18. The panel 16 is made of silicone, whereas the tab 18 is made of a thin strip of polyethylene or polyurethane.

FIG. 5*a* is a schematic sectional view of two centrifuge receptacles each filled with a blood bag 20 which is clamped between two panels 16 each. These panels 16 are disposed such that they have their support portions 16*a* each abutting on the blood bag 20 and their bracing portions 16*b* each being supported on the centrifuge receptacle wall.

FIG. 5*b* is a schematic sectional view of two centrifuge receptacles each filled with a blood bag 20. This blood bag

20 is supported by two panels 16 in such a way that a first panel 16 has its support portion 16*a* resting on the blood bag 20, whereas its bracing portion 16*b* presses against the support portion 16*a* of a second panel. The bracing portion 16*b* of this second panel 16 will in turn brace itself again the centrifuge receptacle wall. Use of the support device of the present invention will thus allow different expansions of sample material containers to be adapted to different sizes of centrifuge receptacles in a flexible manner.

LIST OF REFERENCE SIGNS

10 centrifuge receptacle assembly
12 centrifuge receptacle
14 support device
16 silicone panel
16*a* support portion
16*b* bracing portion
18 tab
20 blood bag
A bending axis

The invention claimed is:

1. A support device (14) in combination with a container (20) of sample material and a centrifuge receptacle, said container of sample material being a bag, said bag resides within said centrifuge receptacle (12), comprising:
said support device is a resiliently flexible panel residing entirely within said centrifuge receptacle;
said centrifuge receptacle includes a bottom;
said resiliently flexible panel (16) has a first support portion completely within the centrifuge receptacle and said resiliently flexible panel has a second bracing portion completely within the centrifuge receptacle;
said resiliently flexible panel generating a restoring force when said first support portion of said resiliently flexible panel and said second bracing portion of said resiliently flexible panel are bent about a bending axis, said bending axis being parallel to said bottom of said centrifuge receptacle; and,
said restoring force urges said first support portion of said panel into engagement with said bag of sample material and said second bracing portion of said panel into engagement with said centrifuge receptacle thus securing said bag in said centrifuge receptacle for centrifugation.

2. The support device (14) in combination with a container (20) of sample material and a centrifuge receptacle, said container of sample material being a bag, said bag resides within said centrifuge receptacle (12) as claimed in claim 1, further comprising:
said bag of sample material includes an upper end and a lower end; and,
said bending axis of said resiliently flexible panel is located at said upper end of said bag of sample material effectively preventing formation of folds in said bag of sample material.

3. The support device (14) in combination with a container (20) of sample material and a centrifuge receptacle, said container of sample material being a bag, said bag resides within said centrifuge receptacle (12) as claimed in claim 1, further comprising:
said first support portion of said resiliently flexible panel and said second bracing portion of said resiliently flexible panel define a bending angle of between 0° and 90° between them when bent about said bending axis.

4. The support device (14) in combination with a container (20) of sample material and a centrifuge receptacle, said container of sample material being a bag, said bag resides within said centrifuge receptacle (12) as claimed in claim 1, further comprising:
said bag of sample material has a height;
said first support portion of said panel engages the height of said bag of sample material.

5. The support device (14) as set forth in claim 1 wherein said resiliently flexible panel (16) includes a handling element on said first end of said resiliently flexible panel.

6. The support device (14) as set forth in claim 1 wherein said resiliently flexible panel (16) is constructed of silicone plastic.

7. The support device (14) as set forth in claim 1 wherein said resiliently flexible panel (16) is of a thickness of between 0.5 cm and 2 cm.

8. The support device (14) as set forth in claim 1 wherein said resiliently flexible panel (16) is at least 20 cm in length.

9. The support device (14) as set forth in claim 5 wherein said handling element is formed as a tab (18).

10. The support device (14) as set forth in claim 9 wherein said tab (18) is resiliently flexible.

11. The support device (14) as set forth in claim 9 wherein said tab (18) has a width between 1 cm and 2 cm and a thickness of about 1 mm.

12. A centrifuge receptacle assembly (10), comprising:
a centrifuge receptacle (12);
said centrifuge receptacle includes a width;
said centrifuge receptacle includes a height;
at least one support device (14) resides completely within said centrifuge receptacle;
said at least one support device (14) supports a container (20) of sample material to be centrifuged within said centrifuge receptacle (12);
said at least one support device is a resiliently flexible panel (16);
said resiliently flexible panel (16) has a first support portion and said resiliently flexible panel has a second bracing portion;
said resiliently flexible panel generating a restoring force when said first support portion of said resiliently flexible panel and said second bracing portion of said resiliently flexible panel are bent about a bending axis, said bending axis being parallel to said bottom of said centrifuge receptacle;
said restoring force urges said first support portion of said panel into engagement with said container of sample material and said second bracing portion of said panel into engagement with said centrifuge receptacle thus securing said container in said centrifuge receptacle for centrifugation.

13. The support device (14) in combination with a container (20) of sample material and a centrifuge receptacle, said container of sample material being a bag, said bag resides within said centrifuge receptacle (12) as claimed in claim 12, further comprising:
said container of sample material has a height;
said first support portion of said panel engages said height of said bag.

* * * * *